United States Patent [19]

Stahlecker

[11] Patent Number: 4,628,680

[45] Date of Patent: Dec. 16, 1986

[54] SPINNING MACHINE WITH A PLURALITY OF SPINNING UNITS

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, both of Fed. Rep. of Germany

[21] Appl. No.: 779,057

[22] Filed: Sep. 23, 1985

[30] Foreign Application Priority Data

Sep. 21, 1984 [DE] Fed. Rep. of Germany ..... 3434724

[51] Int. Cl.[4] ..... D01H 1/135; D01H 7/885

[52] U.S. Cl. ..... 57/401; 57/92

[58] Field of Search ..... 57/400, 401, 406, 92, 57/104

[56] References Cited

U.S. PATENT DOCUMENTS 3,774,382 11/1973 Bartling ..... 57/406 X 3,972,171 8/1976 Handschurch et al. ..... 57/406 X 3,990,219 11/1976 Schewe ..... 57/406 X

FOREIGN PATENT DOCUMENTS 3303985 8/1984 Fed. Rep. of Germany .

*Primary Examiner*—Donald Watkins

*Attorney, Agent, or Firm*—Barnes & Thornburg

[57] ABSTRACT

A spinning machine having a plurality of adjacently arranged spinning units is provided. Each spinning unit is developed as a construction unit along with at least one part of its related driving mechanism. The construction unit is respectively removable as a whole from the machine frame. The machine frame includes devices which require no high degree of precision in alignment with respect to the individual spinning units. These devices include, for example, air channels and cable channels and furthermore driving shafts with driving elements for slowly running drive mechanisms.

32 Claims, 4 Drawing Figures

SPINNING MACHINE WITH A PLURALITY OF SPINNING UNITS

BACKGROUND AND SUMMARY OF THE INVENTION

The invention relates to a spinning machine with a plurality of spinning units arranged on a machine frame, each unit being respectively connectable with a pressurized air and/or vacuum source. The units include respectively, a device for feeding a fiber material, a fiber twisting device, a device for withdrawal of the spun yarn and a device for the winding of the yarn onto a wind-up spool. Driving means are provided for the twisting device and the remaining devices.

In a spinning machine of this general kind as disclosed in German Published Unexamined patent application No. DE-OS 33 03 985, it is known to connect together twisting devices and the remaining necessary parts for the feed of the fibers and for the further guidance of the yarn to form a construction unit. This unit is arranged on a machine frame, and through pivotal movement away or lifting away, can be separated from the associated driving elements which are borne and guided on the machine frame of the spinning machine. With this spinning machine, it is necessary to arrange the driving elements with a high precision inside of the machine frame and furthermore to hold the spinning units with a high precision. The single devices of the spinning unit are connectable in the driving position in an air free manner with the associated driving means. Small securing or connecting errors therefore lead to a result wherein one or several of the devices of the spinning unit do not function exactly. Therefore, there must be a relatively high manufacturing expenditure for the machine frame and the holders for the spinning units in order to avoid these problems. Furthermore, a very exact assembly of the machine frame at the assembly location is required because assembly errors can lead to even worse results.

An object of the present invention is the provision of a spinning machine which exhibits a simple construction.

Another object of the present invention is the provision of a spinning machine having a machine frame manufacturable in a simple.

An even further object of the present invention is the provision of a spinning machine wherein the individual spinning units need be installed with no high degree of precision.

These and other objects of the present invention are attained in providing that each spinning unit is constructed along with at least one part of its associated driving mechanisms as a construction unit. The construction unit is designed to be removable as a whole from the machine frame.

It is thereby contemplated that the spinning units with the driving mechanism, which for example can be single motors, exhibits a basic autonomous unity. In this manner, the degree of precision of assembly of the individual spinning units with respect to one another and with respect to the machine frame has no influence over the functionality of the individual spinning units.

In further developments of the invention, it is proposed that the machine frame includes an air channel extending in the machine longitudinal direction and being connectable to a pressurized air source or to a vacuum source. Separable connecting elements between the air channel and the spinning units are provided. It is advantageous that the connecting elements between the air channel and the spinning units include at least one elasticly deformable element. The machine frame includes only elements which can be connected at the individual spinning units without requiring an exact arrangement of the spinning unit with respect to the machine frame.

In further developments of the invention the machine frame includes at least one electrical connection for each spinning unit. This connection is selectably connectable at counter pieces provided at the spinning units. Also, this electrical connection requires no precision of the arrangement of the parts with respect to one another, especially if the connection is provided with a flexible line. It is especially advantageous that the power lines leading to the electrical connections are disposedin at least one cable channel extending in the machine longitudinal direction.

In further developments of the invention, the machine frame is provided with at least one drive shaft extending in the machine longitudinal direction and engageable with counterpieces of the spinning units. By insertion of the spinning units at the machine frame, the counterpieces are connected by means of transfer elements to the drive shaft. For this arrangement it should be understood that only a relatively slow turning shaft is provided which corresponds to the driving of low rotational speed devices of the spinning units (for example a feeding roller for a fiber feed). Because of the low rotational speed and the low load to be transferred the respective connections thereof require no problemactically high degree of precision in alignment. A low speed extending drive shaft can, without problems be connected to the individual shafts by means of resilient coupling pieces along its length.

In furher developments of the invention, the machine frame is provided with one or several travel rails extending in the machine longitudinal direction for accommodating a servicing or maintenance device. The rails are disposed between the spinning units which arranged in parallel rows on both sides of the machine frame. Thereby it is achieved that the maintenance unit is integrated into the spinning machine and can travel between the rows of the arranged spinning units. The maintenance unit therefore takes up no room need for maneuvering of servicing personnel.

In further developments of the invention it is provided that the machine frame is provided with longitudinal support members forming support places for the spinning units. This results on the one hands in a simple machine frame construcion and on the other hand in an advantageously secure holding arrangement for the individual spinning units. Damping inserts made of elastic material are arranged between the spinning units and the receivers. These damping inserts, due to their elastic deformation secure the spinning units against shoving in the cross or longidutinal direction in an excellent manner. Therefore, it is in most cases not necessary to provide auxiliary securing elements. Furthermore, there is the advantage that very good vibration damping, and therewith sound damping are achieved. Because there is no requirement for an exact alignment of the spinning units to the machine frame, the damping inserts can be constructed relatively softer than in known machines where elastic elements are used.

In further developments of the invention, it is provided that each spinning unit is provided with a holder for the can which holds the fiber material to be processed. The construction unit permits the carrying out of servicing work by stationary servicing devices. With holders for a can, it is achieved that the servicing device can also carry out the changing of the cans. Thereby, it is also possible to remove the individual spinning units in a simple manner from the machine frame of any spinning machine and arrange them on another machine frame. This arrangement is, for example, advantageous when a partial change is to be undertaken whereby another fiber material and/or yarn will be spun only at a few spinning units.

In further developments of the invention, each spinning unit is outfitted with preferably laterally arranged receivers for the gripping of a transport device. Through a special transport device, the respective spinning units can be removed from the machine frame. With the help of the transport device, the spinning units are guided to a corresponding servicing device for repair, servicing or replacement. Because the drives of the individual spinning units are independent from one another, repair work can be carried out without having to shut off the entire machine.

Further objects, features, and advantages of the present invention will become more apparent from the following description when taken with the accompanying drawing(s) which show, for purposes of illustration only, an embodiment/several embodiments in accordance with the present invention.

BREIF DESCRIPTION OF THE DRAWINGS

DETAILED DESCRIPTION OF THE DRAWINGS

The present invention is hereafter explained with reference to an open end friction spinning machine. It is however emphasized that the invention is not limited to such an open end friction spinning machine, but also can advantageously be used with other spinning machines, especially open end rotor spinning machines.

Figure 1:
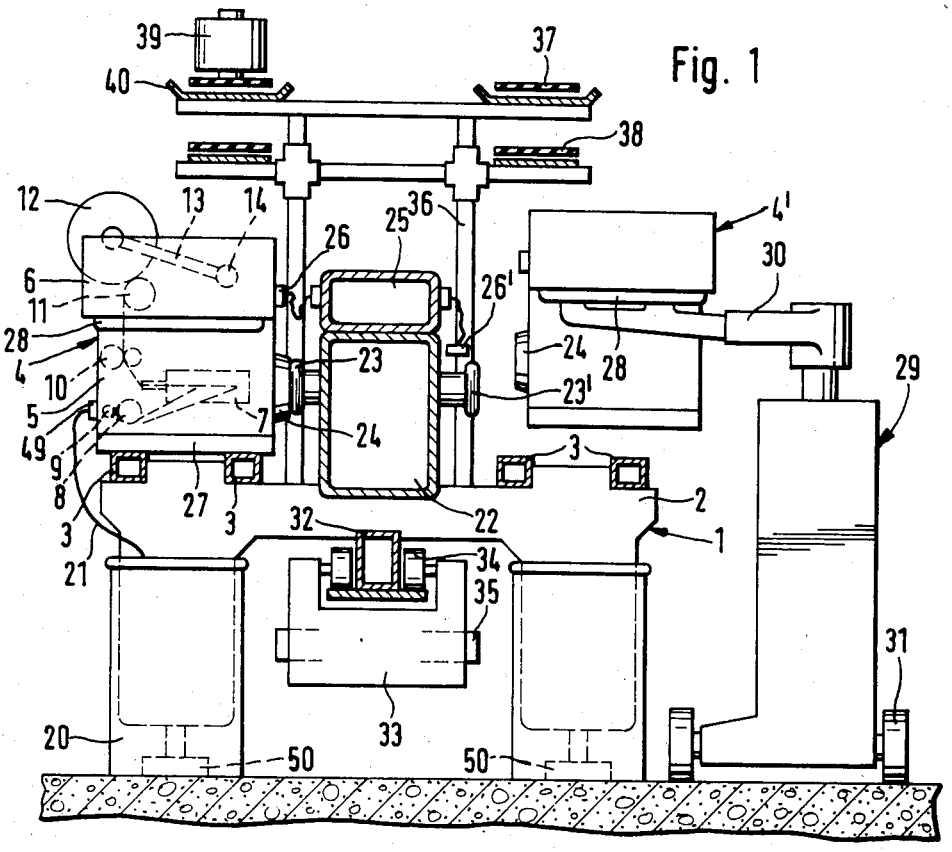
FIG. 1 shows a cross-section through a schematically depicted spinning machine constructed in accordance with the present invention.
Figure 2:
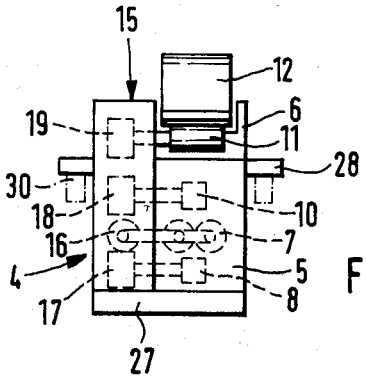
FIG. 2 is a front view of the spinning unit according to FIG. 1.
Figure 3:
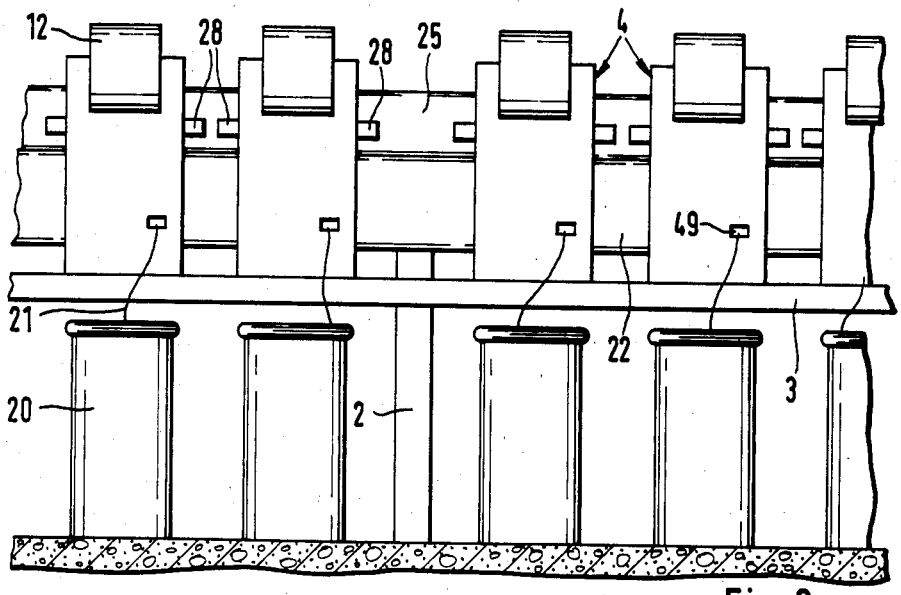
FIG. 3 is a front view of a part of the spinning machine of FIG. 1.

The spinning machine illustrated in FIGS. 1–3 possesses a plurality of spinning units 4 which are arranged adjacent one another in a row on each machine side. The spinning units 4 exhibit a spinning part 5 and a spooling part 6. The spinning part 5 includes a drivable surface device 7 comprising two adjacently arranged friction rollers capable of rotating in the same direction and forming a yarn forming, fiber twisting, wedge-shaped gap therebetween. The drivable surface device 7 is arranged along with a feeding and opening device which includes a feed roller 9 and an opening roller 8. The spun yarn is drawn off by a withdrawal roller pair 10 that is also arranged in the spinning part 5. The withdrawn yarn extends further to a grooved drum 11 which drives a winding spool 12. The winding spool 12 is held by a spool frame 13 which is pivotable about an axle 14 of the spooling part 6.

As especially can be seen on FIG. 2 there is a driving part 15 arranged adjacent the spinning part 5 and the above-arranged spooling part 6. In the driving part 15 there are arranged electrical driving motors 16, 17, 18, and 19 for all the spinning and spooling devices, i.e. for the surface device 7, the opening roller 8, the withdrawal roller pair 10 and the grooved drum 11. These spooling and spinning devices are all driven with relatively high rotational speeds. For the feed roller 9 by means of which the fiber band 21 is drawn out of the can 20 into the spinning unit, a respective separate driving motor can be provided which can be arranged inside of the driving part 15. Because the feeding roller 9 is driven at relatively low rotational speeds and requires for its drive only a relatively small force or power, there can also be another drive for the feeding roller 9 provided, as later described, in conjunction with the FIG. 4 arrangement.

The machine frame 1 of the embodiment of FIGS. 1–3 includes several cross supports 2 arranged at a regular distance from one another and which are supported on the ground or floor with adjustable feet 50. The cross supports 2 are connected with one another in the machine longitudinal direction by means of respectively four longitudinal support members 3 arranged at the same elevation or height. The longitudinal bearer members 3 from the support places for the spinning units 4 with their drives formed together in the construction units. The spinning units 4 are placed on these longitudinal support members 3. The spinning units 4 are provided at their bottom sides with damping inserts or enclosures 27, also referred to as damping pillows, which are constructed to be softly resilient. Because the spinning units 4 do not have to be arranged with respect to one another and with respect to the machine frame 1 in an exact dimensional relationship, the damping pillows 27 which are fixedly connected with the spinning units 4 can be formed very soft and resilient. In this manner, a very effective damping of vibrations is achieved.

In the middle of the machine frame 1 between the longitudinal bearer members 3, an air channel 22 extending in the machine longitudinal direction is provided. This channel includes elastic connecting pipes or connectors for each spinning unit 4. A counterpiece 24 at each spinning unit 4 is provided as a counterpiece to the elastic connection pipes 23, which with the respective connecting pipes 23 are connected upon assembly. Here it is sufficient that the respective spinning unit is shoved in the direction toward the air channel 22 whereby the axially elastically yielding connecting pipes 23 abut in a sealing manner against the counterpiece. Also, in this manner, there is provided the connection a vacuum and/or to a pressurized air stream that is supplied to the air channel 22. Advantageously the connecting pipes 23 include a self-activating quick-closing connection which by the removal of the spinning unit 4 automatically closes itself and which is opened by the connection of the counterpiece 24. In FIG. 1 at the right side, there is illustrated a connecting pipe 23' which is not connected with the spinning unit 4', but which is quickly connected through the installation of the spinning unit 4'.

Above the air channel 23, in each case, there is a cable channel 25 provided which extends in the machine longitudinal direction and which accommodates the electrical lines for the individual spinning units 4. The cable channel 25 is provided with a flexible line and attached electrical attachment 26 (and 26') for each of the respective spinning units 4, and which is engageable with the corresponding plug of the spinning units 4. The cable channel 25 and the air channel 23 are hollow profile members which further provide for the stiffening of the entire machine frame 1.

In the middle of the machine underneath the cross supports 2, there is provided a further longitudinal support 32. This support 32 is attached to the cross bearers 2, and is constructed as a hollow profile which serves to the reinforce the machine frame 1. This longitudinal bearer member 32 is constructed as a travel rail for a travelling maintenance unit 33 hanging from underneath and which includes travel wheels 34. This maintenance device 33 is, for example, outfitted so that it can accommodate changing of the spinning cans arranged at the individual spinning units 4. For this purpose, the maintenance unit 33 is provided with gripping device 35 which are not illustrated in detail, but which are movable outwardly from their illustrated position to accommodate the change of spin cans.

Vertical shafts 36 are attached to the cross supports 2 of the machine frame 1 and serve as receivers for spool transports bands 37 extending along each of the machine sides. To guide the spool transport bands 37 a trough shaped guide channel 40 is provided. The return run 38 of the spool transport band 37 is guided by a guide provided on the support post 36. The spools 39 are laid on the spool transport band by a servicing device (not illustrated) or also manually. This is schematically depicted in FIG. 1 at the left side. The changed winding spool 39 is laid with its facing side upward on the spool transport band 37.

As also can be seen in FIG. 3, the individual spinning units 4 are arranged in a row and separated with respect to one another. The separation is respectively somewhat larger in the region of a cross support 2. In a departure from the embodiment according to FIGS. 1 and 2, the air channel 22 of the embodiment of FIG. 3 is arranged somewhat higher. Furthermore, it is provided that the wind up spools 12 are arranged in the middle with respect to the spinning unit 4, i.e. to the middle of the construction unit formed of the spinning part 5, the spool part 6 and the driving part 15. The spinning units 4 are laterally provided with load bearing receivers 28 by which they can be gripped and lifted off of the machine part 1, as shown in the right half side of FIG. 1. The lifting off is achieved by means of a transport device 29 that is displaceable along travel rails 31 and is adjustable to the respective spinning unit 4. The transport device 29 includes a telescoping type base having an outwardly movable, as well as liftable, pivot arm 30 which is adjustably movable relative to the receivers 28. After loosening the respective connecting pipe connection 23' and the electrical plug in connection 26', the corresponding spinning unit 4' can be lifted and removed with the transport device 29. The drive of the remaining spinning units 4 remains undisturbed. In a like manner the transport device 29 can insert a spinning unit 4' onto the longitudinal bearer members 3 of the machine frame 1. After making the connections 23 with the counter pieces 24 of the spinning units 4 and plugging connection 26' into the counterpiece at the spinning unit 4' the corresponding spinning unit is placed in a ready to operate condition.

Figure 4:
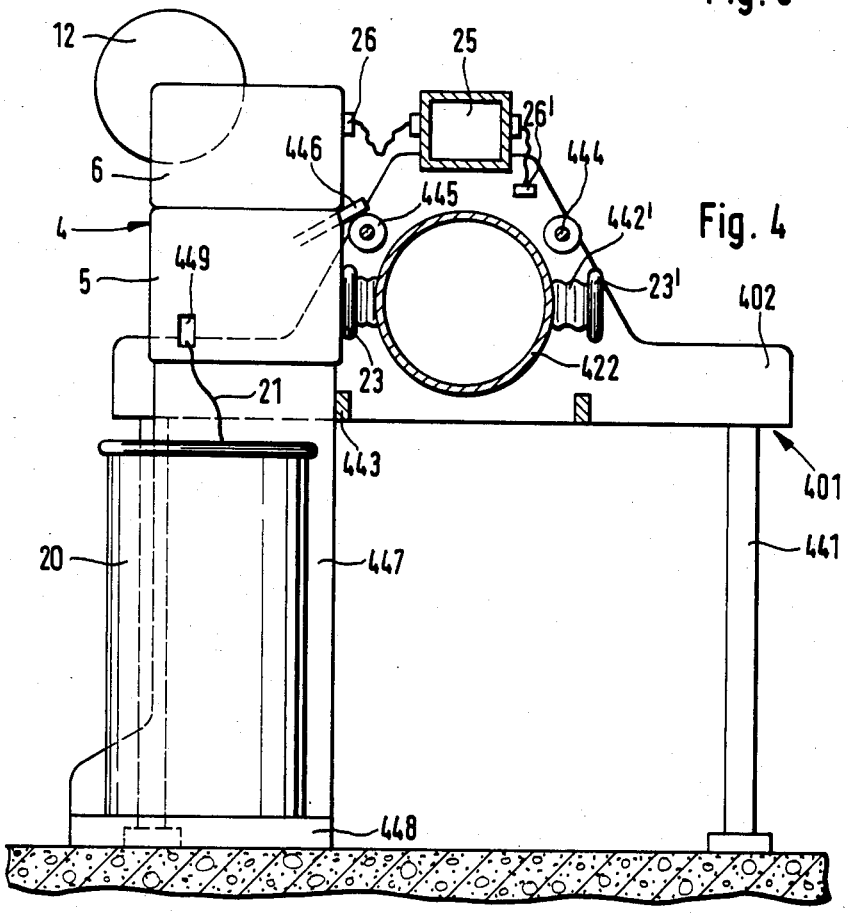
FIG. 4 is a cross sectional view through another embodiment of a spinning machine in accordance with the present invention.

With the development according to FIG. 4, the machine frame 401 is advantageously provided with cast on manufactured cross supports 402 arranged at regular intervals. These supports have advantageously adjustable feet 441 supported on the floor. The cross supports 402 receive a pipe-shaped air channel 422 which is provided with elastic connection pipes 23 for each of the respective spinning units 4. Furthermore, a cable channel 25 with the electrical connections arranged therein is provided at the cross supports 402. The electrical lines are provided with plug in connections 26 for each of the respective spinning units 4.

With the development according to FIG. 4, each spinning unit 4 is provided with a frame shaped under side 447, 448 with which it is supported on the floor. Accordingly, the machine frame 401 does not have to support the weight of the individual spinning units. It is further provided that the machine frame 401 only utilizes the guide protrusions 443 extending along the machine longitudinal direction to form abutments for the spinning units 4 and to limit the sliding movement of the spinning units 4 in the direction of the air channel 422. The connecting pipes 23 exhibit in the horizontal direction a resilient bellows 442 so that the connecting pipes 23 can take the illustrated position 23' shown at the right half side of FIG. 4.

The supporting frame 448, 447 forms a floor plate upon which the cans 20 containing fiber band 21 are placed. The cans are respectively arranged adjacent the respective spinning units 4. The fiber band 21 travels to an inlet 449 of the spinning part 5 of the spinning unit 4, which in this development is laterally arranged at the spinning part 5. This lateral arrangement is advantageous for servicing technology in certain preferred arrangements.

As illustrated in FIG. 4 there is a driving shaft 444 supported at each machine's side in the machine's longitudinal direction in the cross support members 402. These driving shafts 444 are provided with a driving gear 445 for each respective spinning unit 4. The driving gears 445 are coupled together with a counter gear 446 upon the placement or insertion of a spinning unit 4 at its support position. The counter gears 446 are advantageously spring elastically held in the radial direction with respect to the driving shaft 444. These driving shafts 444, together with the driving gears 445 drive the counter gears 446 in the spinning units 4. Corresponding devices of the spinning unit 4, which need to be driven with only a low rotational speed, such as the feeding roller 9 (per FIG. 1) are also advantageously driven by means of shafts 444, gears 445 and counter gears 446.

Although the present invention has been described and illustrated in detail, it is to be clearly understood that the same is by way of illustration and example only, and is not to be taken by way of limitation. The spirit and scope of the present invention are to be limited only by the terms of the appended claims.

I claim:

1. A spinning apparatus having at least one spinning unit arranged on a machine frame, said at least one spinning unit including drivable surface means for twisting fibers into yarn, a fiber feeding device, opening device means, yarn withdrawal means for withdrawing spun yarn from said drivable surface means and winding device means for winding said yarn onto a wind-up spool, drive means being provided for each of said drivable surface means, said fiber feeding device means, said opening device means, said yarn withdrawal means and said winding device means, comprising:

construction unit means selectively removable from said spinning apparatus, said construction unit means including the drivable surface means, the opening device means, the yarn withdrawal means and the winding device means of said at least one spinning unit, said construction unit means further including the drive means for the drivable surface means, the opening device means, the yarn withdrawal means and the winding device means of said at least one spinning uint, said drive means being independent of drive means for other spinning units when said construction unit is installed in said spinning apparatus.

2. An apparatus according to claim 1, wherein said construction unit includes the fiber feeding device.

3. An apparatus according to claim 2, wherein the construction unit includes independent drive means for the fiber feeding device.

4. An apparatus according to claim 1, wherein each said spinning unit is selectively connectable with one of a pressure supply source and a vacuum source.

5. An apparatus according to claim 1, wherein said drivable surface means comprises drivable friction surface means.

6. An apparatus according to claim 5, wherein said drivable friction surface means comprises a pair of adjacently arranged friction rollers drivable in the same rotational direction and forming a yarn-forming wedge-shape gap therebetween.

7. An apparatus according to claim 1, wherein said drivable surface means comprises rotor spinning means.

8. An apparatus according to claim 4, wherein said machine frame includes at least one air channel means for connection with said pressurized air supply source and said vacuum source.

9. An apparatus according to claim 8, comprising separable connecting element means for connecting each said spinning unit with said air channel means.

10. An apparatus according to claim 8, wherein said air channel means extends in a longitudinal direction relative to said machine frame.

11. An apparatus according to claim 9, wherein said connecting element means include at least one elastically deformable element.

12. An apparatus according to claim 1, wherein at least one electrical connection for each spinning unit is provided on the machine frame, said electrical connection being selectively connectable with said spinning unit.

13. An apparatus according to claim 12, wherein said electrical connections are connected with power supplying lines, said power supplying lines being disposed in at least one cable channel means extending along a longitudinal direction relative to said machine frame.

14. An apparatus according to claim 1, comprising at least one drive shaft means for driving the fiber feeding device of said spinning units, said spinning units being selectively engageable with said drive shaft means upon insertion of said spinning units into said machine frame.

15. An apparatus according to claim 14, including transfer element means provided at each spinning unit said at least one drive shaft means being capable of driving said transfer element means, said transfer element means being capable of driving at least one of said spinning unit drive means.

16. An apparatus according to claim 15, wherein said spinning unit includes coupling means engageable with least one of said driving means, said coupling piece means being engageable with said transfer element means.

17. An apparatus according to claim 1, comprising travelling maintenance unit means for servicing said spinning units, said machine frame including travel rail means extending in a longitudinal direction relative to said frame, said travel rail means being capable of movably supporting said maintenance unit means.

18. An apparatus according to claim 17, wherein a plurality of spinning uints are provided, said spinning units being arranged in two parallel rows, said travelling rail means being disposed between said parallel rows.

19. An apparatus according to claim 1, wherein said machine frame comprises at least one support member for supporting said at least one spinning unit.

20. An apparatus according to claim 19, wherein the elastically deformable damping insert means, said damping insert means being arranged between said spinning units and said support members.

21. An apparatus according to claim 1, wherein each spinning unit is provided with holder means for supporting a can containing fiber material to be processed.

22. An apparatus according to claim 1, wherein each spinning uint includes laterally arranged gripping means for engagement with transport device means

23. An apparatus according to claim 1, comprising an plurality of said spinning units.

24. A spinning apparatus having at least one spinning unit arranged on a machine frame, each said spinning unit including drivable surface means for twisting fibers into yarn, fiber feeding means for feeding said fibers to said drivable surface means, yarn withdrawal means for withdrawing spun yarn from said drivable surface means and winding device means for winding said yarn onto a wind-up spool, wherein drive means are provided for each of said drivable surface means, said fiber feeding means, said yarn withdrawal means and said winding device means, wherein each said spinning unit and at least a portion of one of said drive means for said spinning unit comprise a construction unit, said construction unit being selectively removable from said machine frame, said apparatus including travelling maintenance unit means for servicing said spinning units, said machine frame including travel rail means extending in a longitudinal direction relative to said frame, said travel rail means being capable of movably supporting said maintenance unit means.

25. An apparatus according to claim 24, wherein A plurality of spinning uints are provided, said spinning units being arranged in two parallel rows, said travelling rail means being disposed between said parallel rows.

26. An apparatus according to claim 24, wherein said drivable surface means comprises drivable friction surface means.

27. An apparatus according to claim 26, wherein said drivable friction surface means comprises a pair of adjacently arranged friction rollers drivable in the same rotational direction and forming a yarn-forming wedge-shape gap therebetween.

28. An apparatus according to claim 24, wherein said machine frame comprises at least one support member for supporting said at least one spinning uint.

29. An apparatus according to claim 28, including the elastically deformable damping insert means, said damping insert means being arranged between said spinning units and said support members.

30. An apparatus according to claim 24, wherein each spinning unit is provided with holder means for supporting a can containing fiber material to be processed.

31. An apparatus according to claim 24, wherein each spinning unit includes laterally arranged gripping means for engagement with transport device means.

32. An apparatus according to claim 24, comprising a plurality of said spinning units.

* * * * *